United States Patent [19]

Grimes

[11] 4,117,952

[45] Oct. 3, 1978

[54] CAPSULE DISPENSER HAVING CHAMBERS ROTATABLE RELATIVE TO A DISPENSING OUTLET

[76] Inventor: Dustin Marshall Grimes, 721 N.E. 114 Street, Miami, Fla. 33161

[21] Appl. No.: 727,165

[22] Filed: Sep. 27, 1976

Related U.S. Application Data

[63] Continuation-in-part of Ser. No. 712,004, Aug. 6, 1976, abandoned.

[51] Int. Cl.[2] ..... B65D 83/04

[52] U.S. Cl. ..... 221/5; 221/86; 221/91

[58] Field of Search ..... 221/5, 7, 82, 83, 86, 221/89, 91; 206/534, 538, 533; 116/121, DIG. 39; 312/209

[56] References Cited

U.S. PATENT DOCUMENTS

| | | | |
|---|---|---|---|
| 3,557,747 | 1/1971 | Rigney et al. | 221/86 X |
| 3,567,070 | 3/1971 | Gordon | 221/82 X |
| 3,604,559 | 9/1971 | McCall et al. | 206/533 |
| 3,727,794 | 4/1973 | DiEranco | 221/82 X |
| 3,870,192 | 3/1975 | Haley | 221/86 |
| 3,915,526 | 10/1975 | Weiman | 312/209 |
| 3,926,335 | 12/1975 | Dangles et al. | 206/533 X |
| 3,996,879 | 12/1976 | Walton | 116/121 |

*Primary Examiner*—Robert B. Reeves
*Assistant Examiner*—Fred A. Silverberg
*Attorney, Agent, or Firm*—Robert J. Van Der Wall

[57] ABSTRACT

A rechargeable capsule dispenser suitable for simultaneous but separate use by a plurality of users and intended to dispense multiple and variously shaped capsules selected by the users in a time related sequence also determined by the users. The capsule dispenser is formed with a cartridge having a plurality of annularly disposed chambers to hold the capsules and a receptacle base which supports the cartridge. The receptacle base includes a receiving tray and the cartridge may rotate with respect to the receptacle base.

19 Claims, 4 Drawing Figures

CAPSULE DISPENSER HAVING CHAMBERS ROTATABLE RELATIVE TO A DISPENSING OUTLET

CROSS REFERENCE TO RELATED APPLICATIONS

This application is a continuation in part of applicant's co-pending application Ser. No. 712,004 filed Aug. 6, 1976, now abandoned.

BACKGROUND OF THE INVENTION

The present invention relates to the field of dispensing multiple and variously shaped ingestible products such as food, food supplements, vitamins, or medication in the form of tablets, capsules, pills or the like (hereinafter referred to as capsules) and, more particularly to a method and apparatus for sequentially dispensing a plurality of said capsules.

The prior art has primarily focused upon the creation of devices to dispense single tablets of specific predetermined dimension to a single recipient in sequential order, as illustrated by Richardson et al., U.S. Pat. No. 3,904,075, and numerous patents recited therein. Such devices have clearly been aimed at use in the field of oral contraceptives, as positively recited by Richardson et al., and by Finkel, U.S. Pat. No. 3,570,707 and are usually non-rechargable by the users, except that some permit recharge by replacement of a prepackaged blister pack having a frangible membrane, as also disclosed by Richardson et al. Clearly such devices do not allow the user to select the size, shape, number, or content of the capsules to be dispensed, and are limited to utilization by one user at a time. Some of the prior art, while limited as above, has been directed to particular means that prevent alteration or reversal of the order in which the capsules are dispensed and must be destroyed when the supply is exhausted, as illustrated by Thompson, U.S. Pat. No. 3,446,339.

SUMMARY OF THE INVENTION

With the foregoing in mind, it is a principal object of the present invention to provide a method and apparatus for reliably dispensing multiple and variously shaped ingestible products such as food, food supplement or medication in the form of tablets, capsules, pills or the like in a sequential manner.

It is further principal object of the present invention to provide means for dispensing different capsules from each of a plurality of discharge chambers.

It is another principal object of the invention to permit the simultaneous but separate dispensing of individualized portion or dosages of the capsules for a plurality of users, and to insure that the predetermined portions or dosages are taken in the proper time frame.

It is an object of the invention to provide an apparatus suitable for recharging by the user in infinitely variable combinations.

It is an additional object of the invention to provide simple building block means for alteration of the number of users simultaneously, but separately, accomodated by the apparatus.

Moreover, an object of the invention is to provide means in dispensing apparatus that readily displays sequential time related indicia.

Finally, an object of the invention is to provide apparatus of suitable economical design for mounting and operation either on a vertical or horizontal surface.

Other objects and advantages of the present invention will become apparent from the following descriptions and claims, and the accompanying drawings.

In accordance with the invention, there is disclosed a cartridge defining a plurality of bottomless chambers. The chambers are disposed in an annular pattern about the periphery of the cartridge, and are each designed to contain multiple and variously shaped capsules. The cartridge may include means to display sequential time related indicia disposed in concentric and fixed relation to the chambers. The indicia may be established and marked by the user. The cartridge also includes a concentric hollow post having polygonal surfaces about the post's internal circumference. This post also provides means for the user to rotate the cartridge relative to a receptacle base. The hollow post's internal polygonal surfaces mate a first such cartridge with cooperating external surfaces on the top polygonal post of a second such cartridge when the invention is employed in a stacked configuration for multiple users.

The receptacle base cradles and supports the cartridge. The invention may include resilient means to interlock with a flange thus connecting the cartridge and receptacle base, but allowing the cartridge to rotate relative to the receptacle base. An annular surface on the receptacle base provides the bottom for each of the chambers in the cartridge, except that the receptacle base is perforated above a receiving tray. When the cartridge is rotated relative to the receptacle base, the contents of a given chamber pass through the perforation into the receiving tray, from which they may be obtained by the user. The receptacle base may include a flat side to facilitate mounting the invention on a vertical surface. The top and bottom design of the receptacle base enables receptacle bases to be stacked, thus making possible simultaneous but separate dispensing of capsules for a plurality of users with the relative rotation of similarly engaged cartridges. The receptacle bases may be separated to permit recharging of each cartridge by the users. Finally, the receptacle base may include a convex lens to magnify the means for the display of the optional sequential time related indicia that are in concentric relationship with the cartridge chambers.

The invention may further include one way rotation means in the fashion of a ratchet and pawl. Located in the structure where there is relative motion between the cartridge and receptacle base are ratchet teeth type projections in spaced relation equivalent to the number of cartridge chambers. At least one cooperative projection serves as a pawl to permit relative rotation of the cartridge with respect to receptacle base in one direction, but not in the other, and to center each chamber in turn over the perforation leading to the receiving tray.

The invention may also include an annular cover plate removably connected to the top of the receptacle base to cover the tops of the chambers of the cartridge. The top cover plate is removable to facilitate recharging of the cartridge by the user. The top cover plate includes an aperture through which the concentric hollow post protrudes for relative rotation by the user of the cartridge, or of all the engaged cartridges if the invention is being employed in a stacked configuration for a plurality of users. The cover plate also includes a flat side coincident with the flat side of the receptacle base for mounting on a vertical surface.

Also included in the invention may be a base plate removably connected to the bottom of the receptacle base and which provides a flat bottom for mounting the invention on a horizontal surface. The base plate is removable to permit stacking further dispenser units.

Thus it will be seen that the invention is of a modular design which can be stacked to permit simultaneous but separate discharge of capsules for a plurality of users. For example the optional sequential time related indicia could be hours of the day, or days of the week or month, and the plurality of users could be all the members of a family taking various kinds of vitamins or medication. Alternatively, the users could be the occupants of a hospital ward.

BRIEF DESCRIPTION OF THE DRAWINGS

Turning now to the drawings.

DETAILED DESCRIPTION

Referring now to each of the above figures in turn, and using like numerals to designate similar parts throughout the several views, a preferred embodiment will be described.

Figure 1:
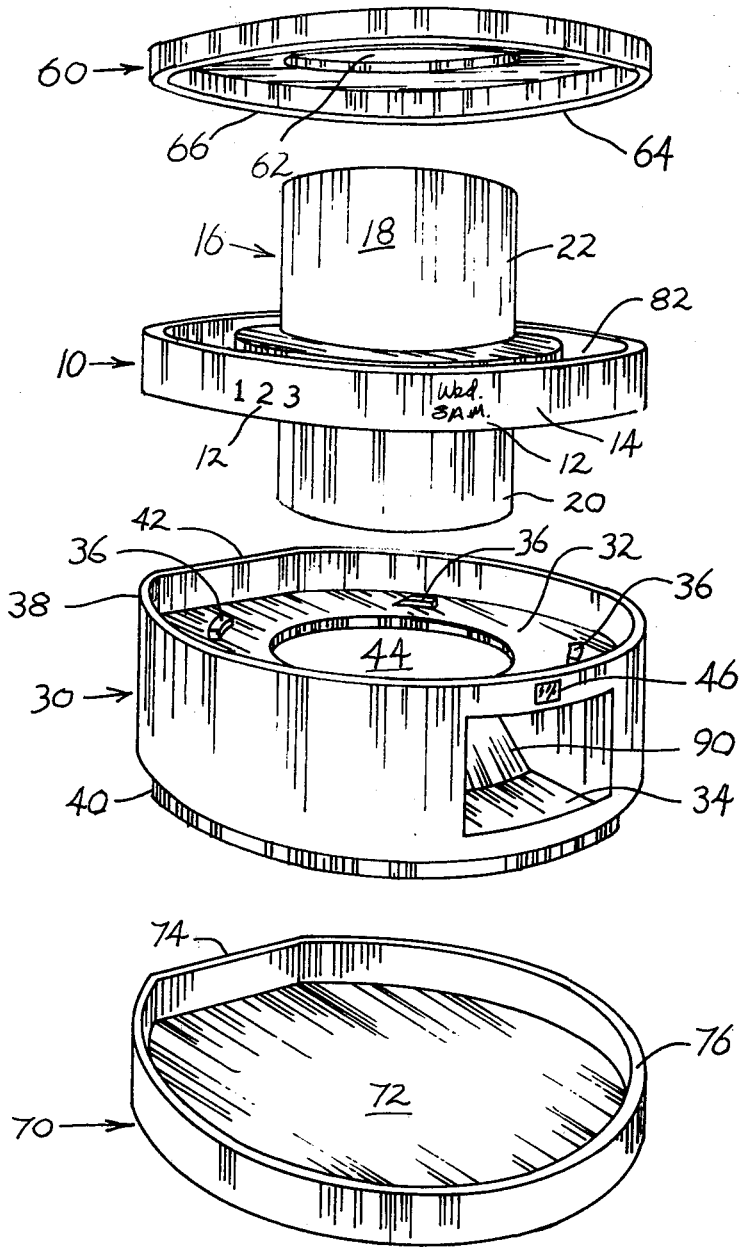
FIG. 1 is an exploded perspective view of the invention.

FIG. 1 discloses a cartridge 10 having sequential time related indicia 12. The indicia 12 may be marked on the cartridge 10 by the user of the invention in accordance with his or her own sequence, and could be handwritten on means for same, such as a roughened surface 14 provided for that purpose. The cartridge 10 includes a hollow post 16 having an upper portion 22, a lower portion 20, and having external arcuate surfaces 18 serving as means to rotate the cartridge 10 relative to the receptacle base 30.

The receptacle base 30 has an annular surface 32 that acts as a bottom to annularly disposed cartridge chambers 82, except directly above a receiving tray 34. The receptacle base 30 includes ratchet means 36 to restrict rotation between the cartridge 10 and the receptacle base 30 to one direction only, with said ratchet means 36 also serving to center cartridge chambers 82 over the receiving tray 34. The top 38 and bottom 40 of the receptacle base 30 are designed to permit a plurality of receptacle bases to be stacked on top of each other when there are a plurality of simultaneous users. The receptacle base 30 also includes a flat side 42 that serves to permit mounting the invention on a vertical surface and interlocks the receptacle bases with each other when a plurality of them are stacked for multiple simultaneous users. The receptacle base 30 is provided with an aperture 44 through which the lower portion 20 of the hollow post 16 is inserted. Finally, the cartridge may include a convex lens 46 to magnify the sequential time related indicia 12.

The capsule dispenser may be provided with an annular cover plate 60 having an aperture 62 through which the upper portion 22 of the hollow post 16 protrudes. The mounting surface 64 of the cover plate 60 is designed to mate with the top 38 of the receptacle base 30, and has a flat side 66 to coincide with the flat side 42 of the receptacle base 30.

The capsule dispenser may be provided with a base plate 70 having a flat bottom 72 to facilitate mounting the invention on a horizontal surface. The base plate 70 also has a flat side 74 to coincide with the flat side 42 of the receptacle base 30. The base plate 70 has a top surface 76 similar to the top 38 of the receptacle base 30, which mates with the bottom 40 of the receptacle base 30.

Figure 2:
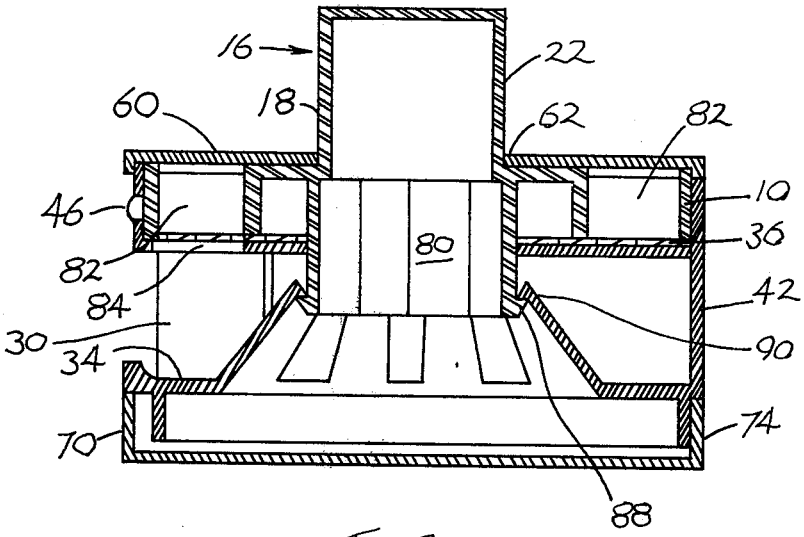
FIG. 2 is a cross sectional view taken along the line 2—2 of FIG. 3.
Figure 3:
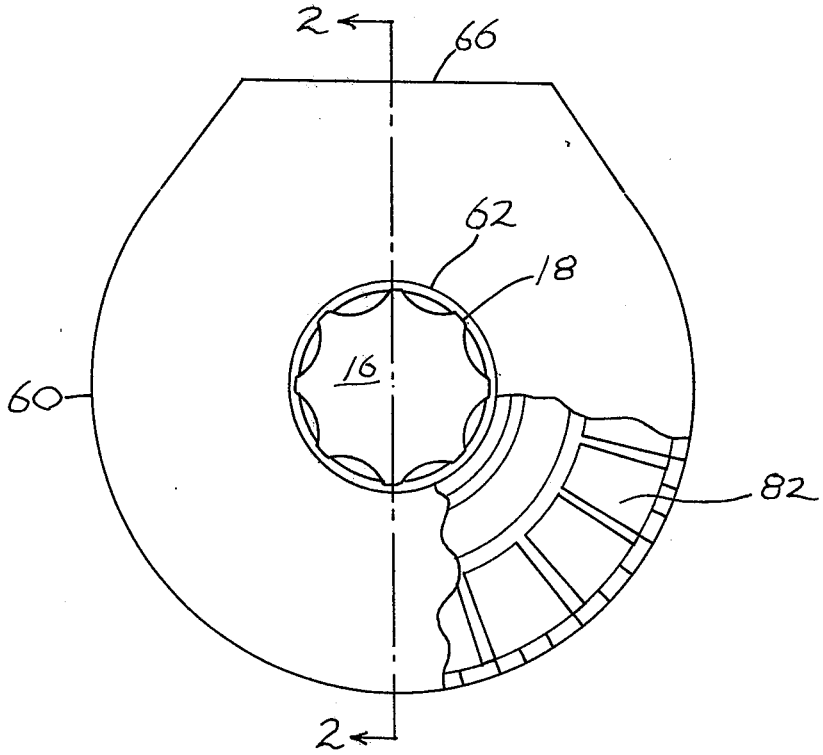
FIG. 3 is a partially broken top view.

Turning now to FIG. 2, there is illustrated the preferred embodiment in cross section along the line 2—2 of FIG. 3. The cover plate 60 is shown with the top portion 22 of the hollow post protruding through the aperture 62 of the cover plate 60. The internal polygonal surfaces 80 are shown inside the hollow post 16. Said internal polygonal surfaces on a first cartridge are used to mate with cooperating external surfaces 18 on a second cartridge when the invention is employed in a stacked configuration for a plurality of users. Annularly disposed chambers 82 are shown around the periphery of the cartridge 10.

The receptacle base 30 is positioned to show its flat side 42 coincident with the flat side 66 of the annular cover plate 60 and the flat side 74 of the base plate 70. The receiving tray 34 is shown beneath a perforation 84 in the annular surface 32 of the cartridge 30 that acts as a bottom to the chambers 82. The perforation 84 allows the contents of the cartridge chamber 82 that happens to be located over the receiving tray 34 to pass through to the tray 34. Ratchet and pawl means 36 center a given chamber 82 over the receiving tray 34 and permit the cartridge 10 to rotate in only one direction with respect to the receptacle base 30. A convex lens 46 is used to magnify the sequential time related indicia 12 shown in FIG. 1. Though they may rotate with respect to each other, the cartridge 10 and receptacle base 30 may be connected by means of a flange 88 and resilient interlocking means 90.

Finally, turning to FIG. 3, an annular cover plate 60 has an aperture 62 through which protrudes hollow post 16. External arcuate surfaces 18 can be used both to rotate the cartridge relative to the receptacle base and to mate with the internal polygonal surfaces of another cartridge. The flat side 66 of the annular cover plate 60 permits mounting on a vertical surface. The cover plate is partially cut away to show the annularly disposed chambers 82 in the cartridge 30.

Figure 4:
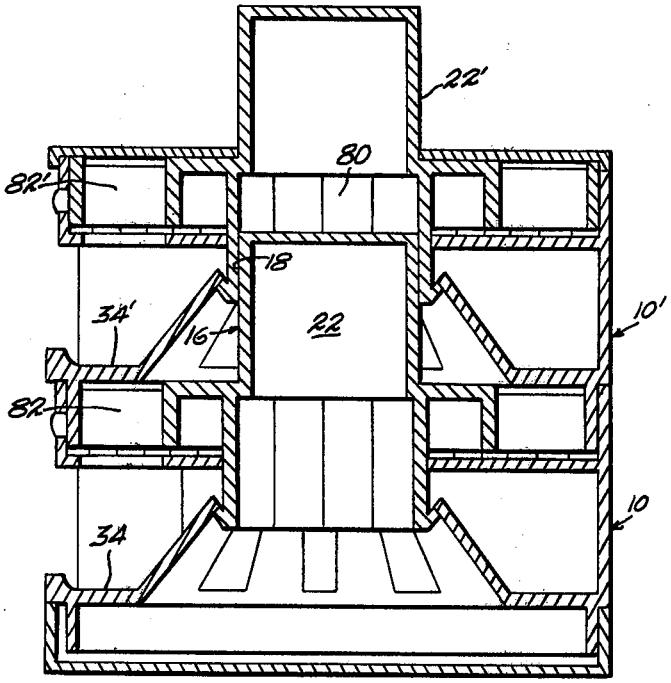
FIG. 4 is a cross-sectional view similar to FIG. 2, illustrating two capsule dispensers of the present invention in an interlocked or rotationally engaged relation for simultaneous rotational operation.

FIG. 4 illustrates two capsule dispensers of the present invention in an interlocked relation for simultaneous rotational operation. The external polygonal surfaces 18 of the upper portion 22 of hollow post 16 of the lower cartridge 10 is operably engaged within the internal polygonal surfaces 80 of an upper cartridge 10' for simultaneous rotational operation therewith. It can therefore be seen that similarly situated chambers 82 and 82' in cartridges 10 and 10' will simultaneously discharge their contents into their respective receiving trays 34 and 34' when the upper portion 22' of upper cartridge 10' is properly manually rotated.

While the invention has been described in connection with a preferred embodiment it will be understood that it is not intended to limit the invention to that embodiment. On the contrary, it is intended to cover all alternatives, modifications and equivalents as may be included within the spirit and scope of the invention as defined by the appended claims.

What is claimed is:

1. A capsule dispenser comprising:

a first cartridge defining a plurality of annularly disposed bottomless and bottom discharging chambers, said chambers each sized to contain multiple and variously shaped capsules, and including a hollow concentric post having internal and external surfaces about the post's internal and external circumference permitting the internal surfaces on the first such cartridge to rotationally but removably engage at least one other cartridge;

a receptacle base supporting the cartridge and having a receiving tray, an annular surface providing a bottom to the cartridge chambers but with a perforation above the receiving tray, and a top and bottom design to facilitate removably stacking the receptacle base supporting said at least one other cartridge, and means to rotate the first cartridge relative to the receptacle base and, when the first cartridge is rotationally but removably engaged to said at least one other cartridge, similarly situated chambers from each cartridge will simultaneously rotate over the perforation in each said receptacle base, whereby each said cartridge will discharge its contents into its corresponding receiving tray.

2. The capsule dispenser as recited in claim 1 which further comprises:

an annular cover plate removably connected to the top of the receptacle base to cover the cartridge chambers, with an aperture through which protrudes the means to rotate the cartridge relative to the base receptacle.

3. The capsule dispenser as recited in claim 1 which further comprises:

a base plate removably connected to the bottom of the receptacle base.

4. The capsule dispenser as recited in claim 1 which further comprises:

means to interlock the cartridge and receptacle base including a flange on one of these parts and resilient interlocking means on the remaining such part, said interlocking means allowing rotation of the cartridge relative to the receptacle base.

5. The capsule dispenser as recited in claim 1 wherein the cartridge further comprises:

means to display sequential time related indicia disposed in concentric and fixed relation to the chambers of the cartridge.

6. The capsule dispenser as recited in claim 1 which further comprises:

a ratchet between the cartridge and receptacle base, said ratchet having a position corresponding to the center of each cartridge chamber, thereby preventing reverse rotation and centering each chamber in turn with respect to the receiving tray.

7. The capsule dispenser as recited in claim 1 which further comprises:

sequential time related indicia in concentric relationship with the cartridge chambers, and a convex lens on the receptacle base to magnify the sequential time related indicia.

8. The capsule dispenser as recited in claim 1 wherein the receptacle base further includes:

at least one flat side to facilitate mounting the invention on a vertical surface.

9. A capsule dispenser comprising a first rotatable cartridge and at least a second similar rotatable cartridge disposed in a removable interlocked stacked relation thereto for simultaneous manual rotational movement;

each of the cartridges including a plurality of annularly disposed bottomless chambers, each chamber being sized and shaped to contain any of a wide variety of capsules;

a first and at least a second receptacle base to support the respective cartridges, each of the receptacle bases providing a receiving tray and a portion defining an annular surface disposed in close proximity to the underside of the chambers defining a bottom wall therefor;

a perforation in each bottom wall, sized and shaped in general conformity with one of the chambers, being in an aligned relationship with respect to each other, and being in close proximity to the receiving tray of each of the receptacle bases;

means to fix the receptacle bases against rotational movement with the receiving trays in an aligned relation; and means to interlock the cartridges relative to the receptacle bases in a manner to permit simultaneous manual rotational movement of the cartridges relative to the receptacle bases for sequential alignment of successive chambers in each of the interlocked cartridges with the aligned receiving trays.

10. The capsule dispenser of claim 9 which further comprises:

means to rotate the cartridges relative to the receptacle bases.

11. The capsule dispenser of claim 10 which further comprises:

an annular cover plate removably connected to the top of the uppermost receptacle base to cover the uppermost cartridge chambers, with an aperture through which protrudes the means to rotate the cartridges relative to the receptacle bases.

12. The capsule dispenser as recited in claim 10 wherein the means to rotate the cartridges relative to the receptacle bases comprises:

a concentric post connected to the uppermost cartridge and having external off-round surfaces about the post's circumference.

13. The capsule dispenser as recited in claim 9 which further comprises:

a base plate removably connected to the bottom of the lowermost receptacle base.

14. The capsule dispenser as recited in claim 9 wherein the means to interlock the respective cartridges and receptacle bases comprises an upwardly outwardly angled flange on each of the cartridges having a predetermined outer diameter, and an upwardly inwardly angled flange on each of the receptacle bases having a predetermined inner diameter somewhat less than the outer diameter.

15. The capsule dispenser as recited in claim 9 wherein the cartridges further comprises:

means to display sequential time related indicia disposed in concentric relation to the chambers of each of the cartridges.

16. The capsule dispenser as recited in claim 9 wherein the means to interlock the cartridges comprises:

a hollow concentric post having internal and external surfaces about the post's internal and external circumference such that the internal surfaces on the first cartridge engage cooperating external surfaces and a second cartridge.

17. The capsule dispenser as recited in claim 9 which further comprises:

a ratchet between each cartridge and base, said ratchet having a position corresponding to the center of each cartridge chamber, thereby preventing reverse rotation and centering each chamber in turn with respect to the receiving tray.

18. The capsule dispenser as recited in claim 9 which further comprises:

sequential time related indicia in concentric relationship with the cartridge chambers, and a convex lens on each base to magnify the sequential time related indicia.

19. The capsule dispenser as recited in claim 9 wherein the means to interlock the cartridges comprises:

coaxially extending central posts, providing like off-round external surfaces in first portions thereof, and like off-round internal surfaces in second portions, each of said external surfaces being sized and configured relative to said internal surfaces for axial sliding reception therein in a non-rotational relation thereto, and to permit unitary rotational movement of said first and second cartridges.

* * * * *